US006243871B1

(12) United States Patent
Fidler

(10) Patent No.: US 6,243,871 B1
(45) Date of Patent: Jun. 12, 2001

(54) GARMENT CLOSURE MECHANISM

(76) Inventor: Jody C. Fidler, 211 E. 18th St., Apt. 5J, New York, NY (US) 10003

( * ) Notice: Subject to any disclaimer, the term of this patent is extended or adjusted under 35 U.S.C. 154(b) by 0 days.

(21) Appl. No.: 09/302,151

(22) Filed: Apr. 29, 1999

(51) Int. Cl.[7] ..... A41B 13/08
(52) U.S. Cl. ..... 2/80; 2/111
(58) Field of Search ..... 2/80, 111, 69, 2/75, 78.2, 78.1, 83, 113, 114, 408, 912; D2/733, 745, 776

(56) References Cited

U.S. PATENT DOCUMENTS

| | | | | |
|---|---|---|---|---|
| 1,758,081 | * | 5/1930 | Masters et al. | 2/80 |
| 1,794,349 | * | 2/1931 | Craig | 2/80 |
| 2,028,602 | * | 1/1936 | Hanson | 2/70 |
| 2,377,004 | * | 5/1945 | Hanes | 2/78 |
| 2,418,050 | * | 3/1947 | Shank | 2/227 |
| 2,520,357 | * | 8/1950 | Brennan | 2/80 |
| 2,523,416 | * | 9/1950 | Brennan | 2/80 |
| 2,524,221 | * | 10/1950 | Feeney | 2/80 |
| 2,570,428 | * | 10/1951 | Clifford | 2/70 |
| 2,625,057 | * | 9/1953 | Siegel et al. | 128/287 |
| 2,638,900 | * | 5/1953 | Gruenberg et al. | 128/288 |
| 2,734,194 | * | 2/1956 | Colvin | 2/80 |
| 3,840,900 | * | 10/1974 | Cruz | 2/77 |
| 3,974,836 | * | 8/1976 | Carlson | 128/526 |
| 4,597,110 | * | 7/1986 | Smith, Sr. et al. | 2/408 |
| 4,637,078 | * | 1/1987 | Southwell | 2/408 |
| 5,033,121 | * | 7/1991 | Larsen | 2/229 |
| 5,367,709 | * | 11/1994 | Teasley | 2/69 |
| 5,806,096 | * | 9/1998 | Pennington | 2/80 |
| 5,819,317 | * | 10/1998 | Conway | 2/111 |
| 5,822,793 | * | 10/1998 | Tokura et al. | 2/69 |

* cited by examiner

*Primary Examiner*—John J. Calvert
*Assistant Examiner*—Alissa L. Hoey
(74) *Attorney, Agent, or Firm*—Ward & Olivo

(57) ABSTRACT

A closing mechanism for garments including a torso portion and a bottom portion wherein the bottom portion extends from the posterior of the torso portion through the wearer's legs and removably attaches to the anterior portion. The bottom portion, or tail panel or lever, contains one or more patches of hook and loop members, and the anterior portion contains one or more corresponding patches of hook and loop members. A further embodiment of the invention, which may be used separately or in conjunction with the closing mechanism, constitutes a resilient portion upon the tail panel.

17 Claims, 6 Drawing Sheets

GARMENT CLOSURE MECHANISM

FIELD OF THE INVENTION

The present invention relates to garments which allow for easy dressing and undressing, and more particularly to garments for infants and toddlers having a tail portion which is removably attached from the front portion.

BACKGROUND OF THE INVENTION

Typical toddler (hereinafter, "toddler" is used as incorporating infants, toddlers and children) wardrobes include garments which consist of a shirt portion, the front and back of which become attached in the toddler's crotch with buttons or snaps. The undershirt version of this style of garment is often referred to as a Onesie®. This type of design, whereby the front and back of the garment are connected in the crotch, is desirable for use with toddlers because it enables a parent (hereinafter, "parent" is used as incorporating parents and other caretakers) to change the toddler's diaper without removing the upper portion of the garment. If this type of garment fits snugly, which is only possible for a short period of time because toddlers grow rapidly, it can also aid in keeping the toddler's shirt down and diaper in place.

There are several other problems inherent with the existing art due to the location and design of the closure, typically in the crotch region with snaps. First, parents need to be able to open and close their toddlers' garments as quickly and safely as possible because toddlers, in general, do not enjoy having their garments and diapers changed, and they often wriggle, kick and cry during the process. The existing art does not permit a parent to open and close their toddler's garment quickly and safely because snaps always require two hands to close. Consequently, the toddler's torso cannot be held safely in place during the changing process. Manipulating snaps in the crotch of a toddler is even more difficult, more time consuming and less safe when the toddler wriggles and kicks its legs. The snaps used with the existing art are often relatively small and, therefore, difficult to control, especially for men with larger hands. Furthermore, due to the circumstances a parent must face when fastening the relatively small snaps in the crotch as required with the existing art, misalignment of the snaps is common and the process must be repeated, frustrating both parent and toddler.

As previously mentioned, another common problem with toddlers' clothing is the fact that they do not usually fit for a long period of time, due to the rapid growth of children of this age. Since toddlers' clothing items are usually only suitable for a very short period of time, parents incur continued and substantial expense in dressing their children. Moreover, toddlers' garments are usually classified by the age and/or weight of the child. These classifications are often extremely misleading because children of this age vary significantly in both size and weight. The two aforementioned sizing problems taken together not only result in significant expense to the parent, but also in unnecessary and frustrating dressing and undressing of the toddler. Commonly, a parent will dress their toddler only to learn that the garment does not fit properly, forcing the parent to undress their toddler and try again.

To resolve these problems, it is desirable to furnish toddlers' clothing which is safe, fast and easy to apply. The ability to apply a toddler's garment with one hand increases the safety of the garment enormously because it allows a parent to have a free hand to stabilize or control the toddler during the outfit and/or diaper changing process. A faster and easier closing garment by nature also makes the garment safer, but additionally leads to a more content toddler, and, therefore, a more content parent.

It is also desirable to furnish garments that may be adjustable to last longer and/or to more closely and snugly fit an individual toddler for a cleaner look, a more comfortable fit and more effective means of holding a diaper in place. The invention herein provides for a toddler garment having a safe, quick, and easy closure system (enabling one-handed closure) which fastens above the narrowest portion between the leg openings with a hook and loop closure. Various embodiments of the present invention accommodate the need for adjustability through the arrangement of the hooks and loops and/or through the use of elastic-type material and/or fabric.

Hook and loop closures such as Velcro™ are well known in conjunction with articles of clothing, such as undergarments, jackets, shoes and gloves, in order to assist in dressing and removal of clothing. For example, U.S. Pat. No. 4,597,110, issued to Smith et. al., describes women's underpants with a hook and loop closure such as Velcro™ in the crotch area. This design, however, does not in any way contemplate use in toddlers' garments and it also does not consider use in conjunction with clothes such as a shirt, top or dress for anyone, including adults. Moreover, Smith does not contemplate adjustability, an extremely useful feature with garments for toddlers, and one that is unnecessary with women's underpants.

One attempt was made to design an adjustable infant garment through the use of string. Teasley U.S. Pat. No. 5,367,709 provides for an adjustable "romper" for infants that can be lengthened or shortened via a pair of drawstrings which pass through the inner portion of the sides of the torso and/or sleeves of the garment. The set of drawstrings operates in a fashion similar to a pair of shoelaces. When tightened, the drawstrings cause the body portion of the romper to "bunch up" thereby reducing the effective length of the garment. Teasley considers incorporating a crotch panel connecting the front and back of the garment with buttons, but Teasley does not contemplate using the panel to accomplish one-handed, safe, quick, easy or adjustable closure. Instead, Teasley uses an elaborate drawstring design on the sides of the torso to facilitate adjustability, in contrast to the convenient hook and loop fastener and/or elastic designs discussed herein. In addition, because the Teasley romper bunches up at the sides, it is unsightly and probably uncomfortable to wear. Furthermore, the use of drawstrings with toddlers may make this design unsafe.

Conway U.S. Pat. No. 5,819,317 relates generally to an infant garment which incorporates an absorbent material in the crotch area to reduce leaking. Essentially, it combines the concept of a T-shirt and a diaper. In discussing possible embodiments of the design, Conway mentions that the snaps located along the edges of the front and back of the garment, which connect between the legs at the narrowest portion of the crotch, may be replaced with hook and loop closures. However, Conway in no way contemplates using such a device in order to facilitate adjustability or to provide a safe, quick and easy closure capable of being fastened with one hand.

In fact, Conway does not discuss safety, ease of closure or adjustability at all. This is not surprising because the intent of the Conway invention was to provide protection to a child and parent from a leaking diaper, not to provide a quick, one-handed closing or adjustable garment. It is further evident that Conway did not contemplate a one-handed closing or adjustable garment because the snaps in Conway are at the edges of the narrowest portion between the leg openings of the crotch. Incorporating hook and loop closures at these edges of a garment, where they may contact the crotch and/or upper legs of a toddler, is even more unsafe, impractical and inconvenient than having snaps there as discussed previously.

Conway in no way addressed the problems related to manipulating closure in the narrowest portion of the crotch with a moving toddler, in general, and Conway specifically fails to address the irritation affiliated with imperfect alignment of closure in that area. For example, Velcro™ closures in the crotch, where the Velcro™ members are flush against six edges of the garment when the garment is in the open position (as they are depicted flush in Smith), may be inappropriate for toddlers because the hook portion of the Velcro™ can irritate the toddler if not perfectly aligned, and a toddler can neither tell a parent that the hooks are irritating, nor can it readjust the closure him or herself. Because toddlers commonly move during the changing process, perfect alignment of the hooks and loops is unlikely to occur.

In addition, various configurations of hook and loop closures which enhance adjustability, closure strength and optimal fit, are not suggested by Conway. Conway also does not contemplate the use of elastic or fabric/material having an elastic quality to create an adjustable garment. Having a longer lasting and more optimally fitting garment is extremely useful for a growing toddler.

The existing art is void of garments for infants, toddlers and children which provides for a safe, quick, easy and one-handed method of fastening their garments by the use of one or more sets of hook and loop fasteners and/or elastic-like material/fabric in such a manner which may allow for versatile adjustability and optimal fit.

SUMMARY OF THE INVENTION

The present invention relates to garments that can safely, quickly and easily be closed and may also be adjusted, using hook and loop fasteners and/or a material or fabric having an elastic quality. Although the present invention may be used to accommodate a growing toddler, the present invention may also find use in garments for older children and adults. The present invention may also provide particular use in bedridden adults and those who may be cared for by others, as in a nursing home, hospital or home care environment. The designs described herein may be useful for any age or size individual, and the descriptions and references to infants, toddlers and children herein are not intended to limit the scope of the present invention defined by the claims herein.

Specifically, the design herein proposes a one-piece garment which covers at least the front and rear torso region and the crotch region. The garment includes a tail panel that extends from the back of the garment between the legs and is fastened onto the anterior portion of the garment anywhere above the narrowest portion between the leg openings of the crotch of the garment in the closed position. The invention herein includes garments having multiple closure positions whereby the adjustability of the garment is increased. In another embodiment of the present invention, the adjustability of the garment is also increased when material or fabric with an elastic quality (i.e., spandex) is used on at least a portion of the tail panel.

The garment closure mechanism described herein increases the garment's safety because it enables one-handed closure, thereby providing the parent with a free hand to assist in controlling or stabilizing the toddler during the diaper or clothes changing process. It is also a safer and more convenient means of closing a toddler garment because the changing process can be accomplished in much less time than with the closures of the existing art. The present invention eliminates the need to align tiny snaps with comparatively large hands in the crotch of a wriggling and kicking toddler. Since the changing process is often an arduous one for the toddler, and therefore also for the parent, the ease and speed of the present invention leads to a more content toddler. A happier toddler results in a happier parent.

Furthermore, the present garment can be designed to fit a variety of body types through adjustability which can be accomplished in varying degrees. The garment is ideal for a growing toddler as it may fit optimally and comfortably for a much longer duration than conventional toddler clothing. A longer lasting garment is more cost effective, but also more convenient for the parent because it eliminates the all too common routine of attempting to dress the toddler, only to discover that the garment is too big or too small. In such circumstances, a parent must undress the toddler and commence the dressing process from the beginning. Additionally, any degree of adjustability will allow for an improved garment fit, which is both more visually appealing and more comfortable to the toddler.

The aforementioned garment consists of front, back and side sections similar to those of a typical shirt such as a T-shirt, undershirt, tank top, long-sleeved shirt, sweatshirt, halter or turtleneck. The garment may also include a hood, a skirt (which is permanently affixed or removably attached so that the garment becomes or appears to be a dress) or any other ornamentation affixed to the front, back, side, tail or crotch sections. Further, the back section of the garment extends into a tail panel which incorporates a closing means. The tail panel passes between the toddlers' legs whereby a section of the closing means on the tail panel fastens onto the anterior portion of the garment anywhere above the narrowest portion between the leg openings of the crotch.

More specifically, the aforementioned closing mechanism comprises a hook and loop fastening system, such as Velcro™, one segment located on the anterior panel or front of the garment and the other corresponding segment located on the tail panel,lever or strap extending from the posterior or back of the garment. The segment of the closing mechanism on the anterior panel comprises one or more patches of hook and/or loop members material fixed non-moveably thereon and positioned in any predetermined geometrical or aesthetic pattern or set of patterns. The size of the patch or the use of multiple patches increases adjustability, ease, speed and safety of closure in addition to closure strength.

The segment of the closing mechanism which is located on the tail panel comprises the complementary loop and/or hook members fixed non-moveably in one or more patches onto the tail panel extending from the posterior of the garment. When the fastening system is in the closed position, the lowest point of closure of the present invention is anywhere above the narrowest point between the leg openings of the crotch.

Various type and degrees of adjustability are possible in the present invention. The loop and/or hook members may also be arranged in some predetermined pattern or set of patterns sufficiently wide to accommodate adjustability and can be larger in size or positioned in such a way as to increase adjustability. Another way adjustability may be accomplished is through the use of elastic or fabric/material with an elastic quality on the tail panel. The tail panel can be specifically designed as a lever arm or counter pulley when affixed to the anterior panel. This union permits adjustable tension creating optimal comfort and fit of the garment allowing for growth of the toddler.

One critical advantage of the closing mechanism described herein is the creation of a single-handed mechanism to removably attach the front and back of toddler garments, making the process a much safer one. It frees one hand which can be used to stabilize or control the toddler during the changing of their clothes or diaper. The closing mechanisms and their location described herein can also provide leverage to the parent performing the closing process when attaching the tail panel to the anterior panel. Leverage eases and quickens the closure process and makes the garment fit more snugly, and thus is more comfortable for the toddler and more aesthetically pleasing for the parent.

The closing mechanism of the present invention is in sharp contrast to the existing art, which generally requires the use of both hands to pull together two separate parts which are joined in the crotch with snaps, a difficult area to access. It does not require two parts to be pulled together. Instead, to attach the tail panel to the anterior of the garment, only the tail panel itself must be pulled.

Furthermore, the various configurations and attachment positions of the closure mechanism, examples of which are described herein, provide for adjustability of the garment. Consequently, a parent can alter the size of the garment to suit the needs of his or her toddler by engaging the hook and loop members in several different areas. Adjustability may also be provided by the use of elastic or fabric/material with elastic qualities (i.e., Lycra®, spandex, or other blends which afford elasticity to the fabric) on the tail panel, a feature absent from existing garments which are typically made of cotton. The adjustability created by the present invention enables the same garment to fit the same toddler for a much longer period of time than existing art, making the invention more practical and cost effective. A tail panel including an elastic quality acts as a lever arm or counter pulley which creates tension and ensures optimal comfort and fit, another quality absent from the existing art. Adjustability also helps to overcome the problems created by the fact that the sizes on labels for toddlers' clothes are often extremely misleading and lead to unnecessary changing.

The present invention contemplates the use of the hook and loop portions interchangeably. That is, the hook members may be on the front panel and the loop members on the tail panel, or alternatively, the loop members may be on the front panel and the hook members on the tail panel. The alternative arrangements may prove useful in certain configurations of the closure system of the present invention, as desired by a particular individual, to increase safety, comfort, adjustability and closure strength.

Additional features and variations of the invention relayed herein will be apparent from the following descriptions, drawings and claims. While specific configurations are disclosed, the invention is not limited to those examples and as such, variations may be made which are within the spirit of the invention herein.

DETAILED DESCRIPTION OF THE DRAWINGS

Figure 1:
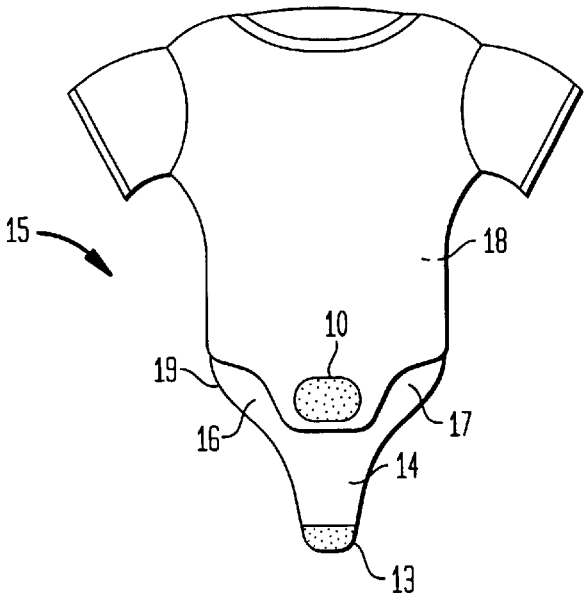
FIG. 1 is a perspective view of an embodiment of the present invention, depicting a garment having a tail strap in the opened position.

Now turning to the details of the various configurations contemplated by the design relayed herein, FIG. 1 shows a preferred embodiment of the present invention in the open position. FIG. 1 depicts a garment 15 comprising a tail strap, lever or panel 14 having a patch of hook or loop members 13 fixed thereon. The lower anterior torso portion of garment 15 has a corresponding patch of hook and loop members 10 fixed anywhere above the narrowest portion between the leg openings of the crotch when the garment is in the closed position. The lower anterior portion of the garment depicted in FIG. 1 is shaped such than when worn by the toddler, it extends partially between their legs. However, the shape of the lower abdomen portion may also be of a standard T-shirt, for example. Additionally, the depicted shape of patch 10, is merely exemplary and can specifically be increased or decreased in size, i.e., cover a larger or smaller portion of the garment, to vary adjustability, safety, strength and ease of closure. Furthermore, this patch may be a completely different shape such as a circle, rectangle, square, triangle, flower, etc.

Patch 10 is affixed somewhere above the narrowest portion between the leg openings in the crotch of garment 15. Preferably, the sides of patch 10 are not in direct contact with the edges of the leg openings of the garment 15 to prevent the toddler's skin from being scratched and/or irritated by the edges. If patch 10 does reach the edges of the leg openings, then patch 13 on the tail panel preferably will not extend as shown to contact the side edges of the tail panel or its horizontal length will be less than that of patch 13.

However, even in the preferred position, patch 10 may contact the bottom edge of the anterior of the garment and patch 13 may contact the bottom edge (when in the open position) of tail panel 14. These portions generally would not contact the skin as a diaper or underpants are worn.

A corresponding patch 13 consisting of Velcro™ closure members (loops or hooks) is positioned on the inside of tail panel 14 which extends from the posterior 18 of the garment. Patch 13 is positioned upon tail panel 14 such that it may be wrapped between the legs of the toddler and removably connected to patch 10. The hook and loop members of patch 13 may also be enlarged to allow for further adjustability. Thus, many alternative arrangements exist. Patches 10 and 13 may be of similar size such that they correspond when connected. Patch 10 may be larger than patch 13, so that when patch 13 is removably fastened to patch 10, unconnected Velcro™ members remain on patch 10. Alternatively, patch 13 may be larger than patch 10, so that a portion of the Velcro™ members of patch 13 are removably fastened to patch 10, while the rest remain unconnected. In the last configuration, it is preferred that the toddler's skin is not exposed, i.e., is covered by a diaper, to prevent irritation from the unconnected members of patch 13, especially if they are of the hook nature.

In order to engage the closing mechanism, it is necessary to pull tail panel 14 between the legs of the toddler, such that patch 13 comes into contact with patch 10. These two members being attached creates two leg openings 16 and 17 where the toddlers' legs will extend from the garment. The length of the garment is adjusted by changing the height at which patch 10 and patch 13 are engaged. The lining 19 of the leg openings 16 and 17 may optionally be lined with an elastic material to improve comfort, fit and to assist in keeping the garment in place on the toddler. Fabric or material with an elastic quality may be used to line the leg openings of any of the embodiments of the invention. Furthermore, at least a portion of the tail strap or panel 14 of the garment may be made out of elastic or some other flexible material, so that tail strap 14 will act as a lever arm or counter pulley when affixed to patch 10. (See FIG. 5). This connection permits adjustable tension creating optimal comfort and fit of the garment.

Figure 2:
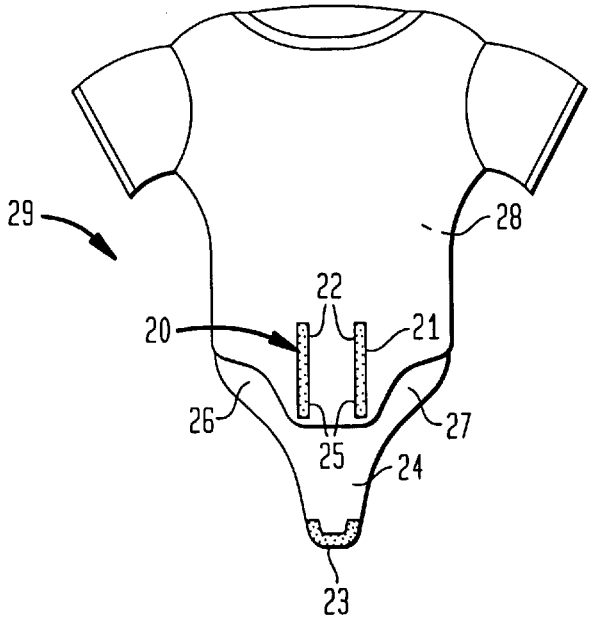
FIG. 2 is a perspective view of another embodiment of the present invention, depicting a garment with a tail strap in the opened position and having multiple vertical patches.

FIG. 2 depicts another possible embodiment of the present invention using multiple patches. In this configuration the size-adjustment mechanism consists of two vertically or longitudinally extending parallel patches 20 and 21 fixed on the anterior of the garment 29 in conjunction with a complementary tail patch 23 fixed on the tail panel or strap 24 extending from the posterior of the garment 28. Alternatively, multiple patches may be substituted for patch 23 positioned in line with vertical patches 20 and 21. (See FIGS. 9 and 9A). These two members being attached creates two leg openings 26 and 27 where the toddlers' legs will extend from the garment.

The length of the garment is adjusted by changing the height at which patch 23 on tail panel 24 is removably attached to vertical or longitudinal patches 20 and 21. For example, to accommodate a smaller child, the tail patch 23 may be connected to the corresponding longitudinal patches 20 and 21 at positions 22, thereby reducing the size of leg openings 26 and 27 and reducing the functional height of garment 29 from the head or neck opening to the crotch. Conversely, for a larger child, the tail patch 23 may be connected lower on the longitudinal patches 20 and 21 at positions 25 in order to effectively increase the size of leg openings 26 and 27, lengthening the functional height of the garment and accommodating a larger toddler.

The arrangements for patches 20 and 21 may be varied. First, there may be more than two patches. For example, one or more patches or strips may be fixed between patches 20 and 21. Furthermore, patches 20 and 21 may be provided toward the sides of garment 29. In this configuration, the extremity of tail panel 24 must be wide enough to accommodate the distance between patches 20 and 21, but there may be two patches on tail panel or lever 24 instead of a single tail patch 23 (see FIGS. 9 and 9A). These two patches on tail panel 24 will correspond and be complimentary to patches 20 and 21. Also, vertical patches 20 and 21 need not be parallel to each other nor straight. For example, they may be trapezoidally opposed, or they may have a zig-zig or arcuate shape. Additionally, the patches 20 and 21 may be shortened or lengthened longitudinally for decreased or increased adjustability and/or aesthetic or decorative purposes.

Figure 3:
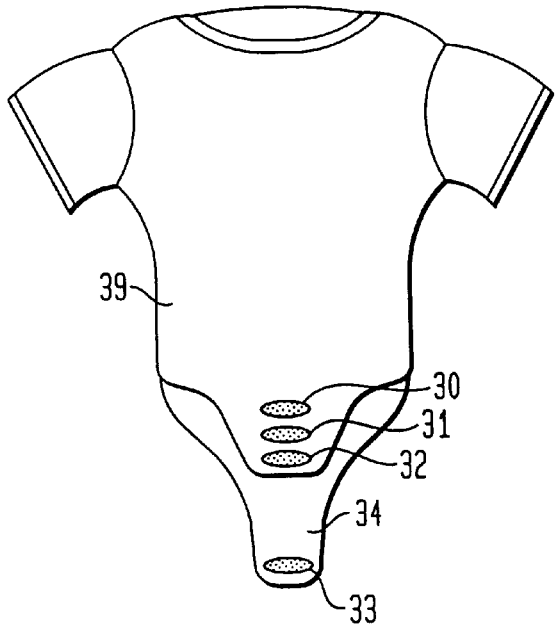
FIG. 3 is a perspective view of another embodiment of the present invention, depicting a garment with a tail strap in the opened position and having multiple horizontal patches.

An alternate embodiment of the present invention is described in FIG. 3. In this arrangement, the size-adjustment mechanism encompasses a tail patch 33 and a series of anterior panel patches 30, 31 and 32. In this embodiment, the functional length of this garment is determined by which patch, 30, 31 or 32, the tail patch 33 is fastened to. To accommodate a smaller toddler, the tail patch 33 would be fixed to patch 30, reducing the longitudinal length of garment 39 in the closed position and minimizing the size of the leg openings. Conversely, to accommodate a larger toddler, the tail patch 33 would be fixed to patch 32, increasing the longitudinal length of garment 39 in the closed position and maximizing the size of the leg openings.

The arrangement of the horizontal or lateral patches 30, 31 and 32 in this configuration is being used to illustrate the general concepts and principles of this design. Nothing in this description should be construed to limit the scope of this invention to a specific number, shape, arrangement or configuration. Note that there are several alternate configurations which, although may differ slightly in form or appearance, are within the scope of the invention relayed herein. For example, there may be less than or more than 3 patches on the anterior of the garment.

The additional advantages of the embodiments relayed in FIG. 2 and FIG. 3 are that they provide for substantial adjustability. Furthermore, these embodiments utilize much less hook and loop member material as compared to a single, larger patch on the anterior panel, which may be enlarged to a point at which the entire bottom portion of the anterior panel contains Velcro™. Therefore, they are less expensive to produce. Also, various patterns and configurations of the hook and/or loop members may be used to provide different designs such as dots, stripes, shapes, swirls, cartoon characters, animals, or animated scenes, for example.

Figure 4:
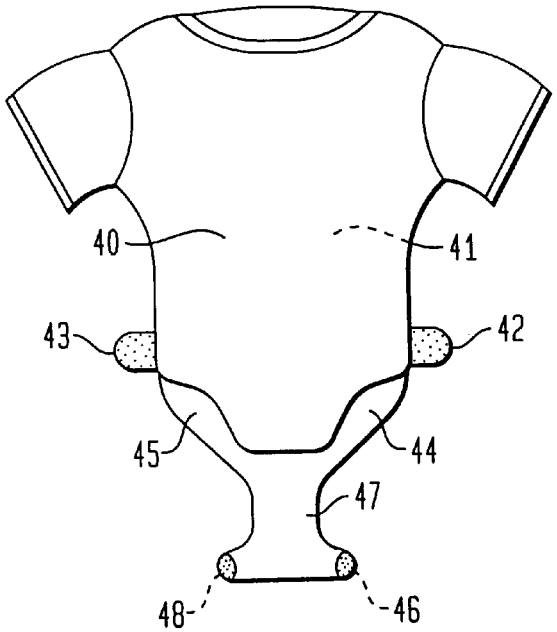
FIG. 4 is a perspective view of an additional embodiment of the present invention, depicting a garment with a tail strap in the opened position and having two patches at or near the bottom left and right sides of the torso of the garment.

Another form of the present design is described in FIG. 4. The design in FIG. 4 consists of the same general one-piece garment 40, with a tail lever or strap 47 extending from the posterior 41 of the garment. In this embodiment, the posterior of tail panel 47 comprises two laterally extending flaps containing thereon patches 46 and 48 (depicted in FIG. 4 with dashed lines to represent that the patches are on the posterior of tail panel 47 when viewed in the open position). This design further comprises flaps 42 and 43 connected at or near the sides of the garment at or near the juncture of posterior 41 and the anterior panel. The height of these flaps relative to the leg openings may vary depending on the length of tail strap 47. Preferably, the flaps are at or near leg openings 44 and 45. Each flap 42 and 43 contains a patch of Velcro™ that encompasses all or a portion of the flap. This garment is fastened by pulling tail panel 47 between the toddler's legs, whereupon the two patches on flaps 42 and 43 are fastened to the corresponding tail patches 46 and 48 positioned on the posterior of tail panel 47.

The length and fit of this garment is altered by changing the position of the flaps 42 and 43 with respect to the folded-over tail strap 47. Again, the description of this figure is meant only to convey the principles of the current invention and is not meant to limit its application to the specific designs exemplified herein.

Figure 4A:
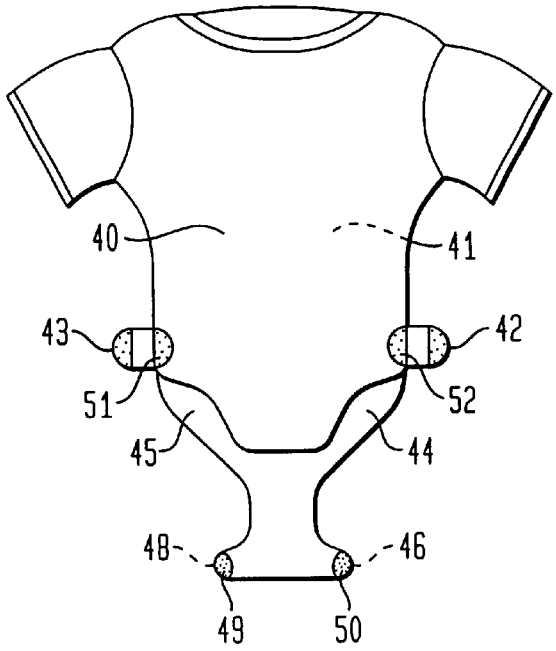
FIG. 4A is a perspective view of an additional embodiment of the present invention, depicting a garment incorporating the essential features of FIG. 4 with the essential features of FIG. 2.

For example, FIG. 4A depicts a further embodiment of the present invention similar to that depicted in FIG. 4 whereby the closure mechanism provides additional security. FIG. 4A incorporates the closing mechanism described above with reference to FIG. 4, using patches on flaps 42 and 43 which connect to flaps 46 and 48 on tail panel 47. As such, the different configurations, sizes and positions described above are incorporated with respect to this embodiment. For further security and ease of closure, the anterior side of tail panel 47 also includes patches 49 and 50. These patches 49 and 50 correspond to patches 51 and 52 on the anterior panel of garment 40. Thus, tail panel 47 includes patch 51 and 52 on the anterior, and patches 46 and 48 on the posterior. Here, when closing means 47 is pulled through the toddler's legs, patches 49 and 50 attach to patches 51 and 52, and then flaps 42 and 43 may be affixed to corresponding patches 46 and 48. For even more closure strength, the anterior of tail panel 47 can have a third patch between patches 49 and 50 that connects to a patch on the anterior of the garment 40 between patches 51 and 52.

Figure 5:
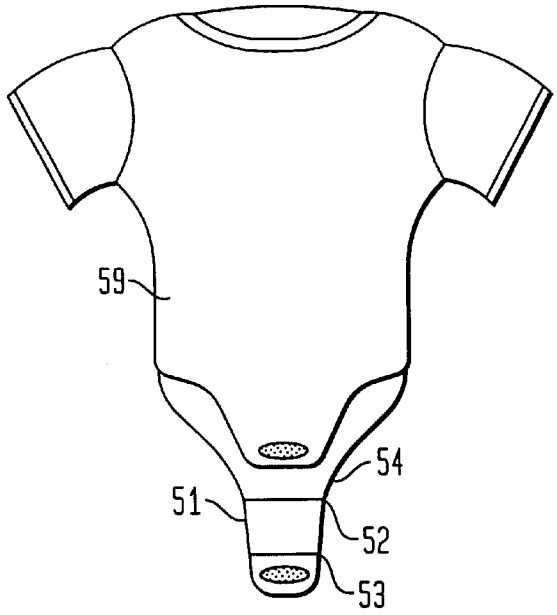
FIG. 5 is a perspective view of an embodiment of the present invention, depicting a garment having a tail strap in the opened position, where the tail strap incorporates a fabric having elastic properties.

Adjustability and closure strength may also be provided by adding elasticity and resilience to the tail panel or lever in the garments described herein. This feature may be used in conjunction with the other embodiments of the invention as shown in FIG. 5, or separately as in FIG. 5A. FIG. 5 depicts a garment 59 incorporating the closure mechanism described herein, and further incorporates a fabric having elastic properties. Tail panel or strap 54 is shown having a stretch panel 51 formed of elastic, spandex, Lycra® or any other fabric having elastic properties. Stretch panel 51 is attached at locations 52 and 53 by stitches or other permanent affixation means. The size of stretch panel 51 is determined by the distance between affixation positions 52 and 53, and variations in size and elasticity strength are contemplated for degrees of adjustability and leverage.

Figure 5A:
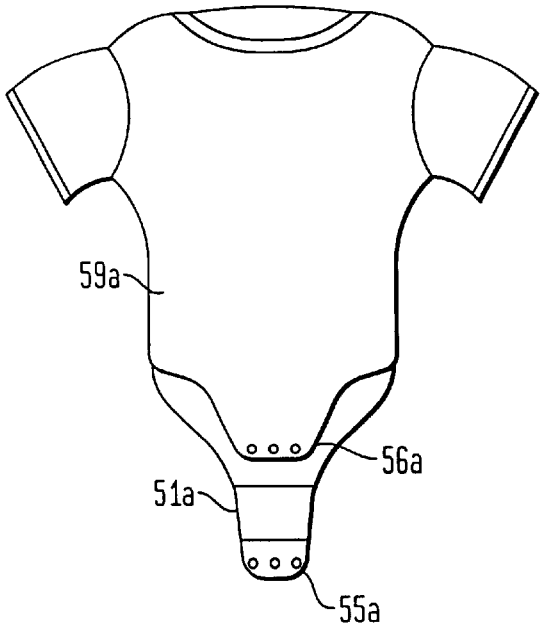

FIG. 5A depicts a garment 59*a* including the stretch panel 51*a* and including corresponding groups of snaps 55*a* and 56*a*. These snaps may be used in place of the Velcro™ closures of the alternative embodiments of the present invention.

It should be further noted that all the configurations relayed herein that relate to one-piece toddlers' garments should not be construed as to negate the possibility that this design contemplates sleeves of different lengths, dresses, hoods, elastic or other ornamentation from being affixed on said garment. Elastic or an elastic-quality material may be included around a portion or all of the leg openings as previously discussed. Further, the anterior, posterior and/or shoulder/neck area of the garment as depicted herein may contain openings for ease in dressing/undressing, decorative purposes or for comfort. These openings may close by way of any known means, including Velcro™, snaps, buttons, zippers, etc. Openings provided on the anterior and/or posterior of the garment may extend partially from the neck toward the bottom of the torso or may extend fully from the neck to the leg openings or crotch. Various examples of these enhancements are depicted and described below with reference to FIGS. 6 through 9A.

Figure 6:
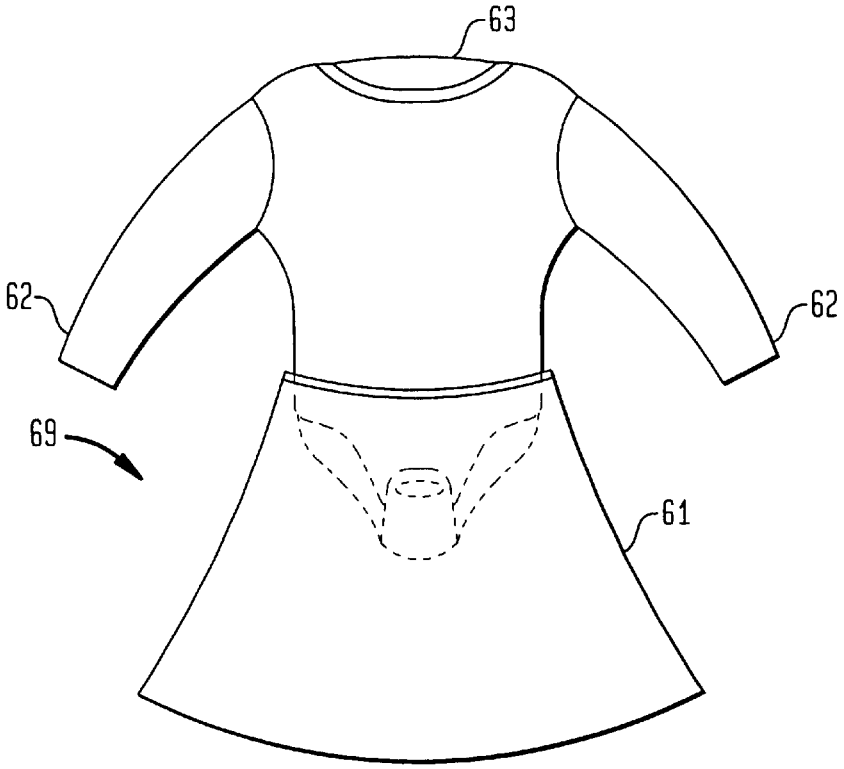
FIG. 6 is a perspective view of an embodiment of the present invention, depicting a dress incorporating the closure mechanism of the present invention having a tail strap in the closed position.

FIG. 6 depicts a garment 69 incorporating any of the closure mechanisms in the closed position further comprising a skirt 61 attached permanently or removably to the mid-section such that the garment resembles a dress. This embodiment is further depicted as including long sleeves and decorative frills at the neck opening 63 and cuffs 62. Of course, the garment including a skirt may have short sleeves or no sleeves, and may or may not include the frills as depicted.

Figure 7:
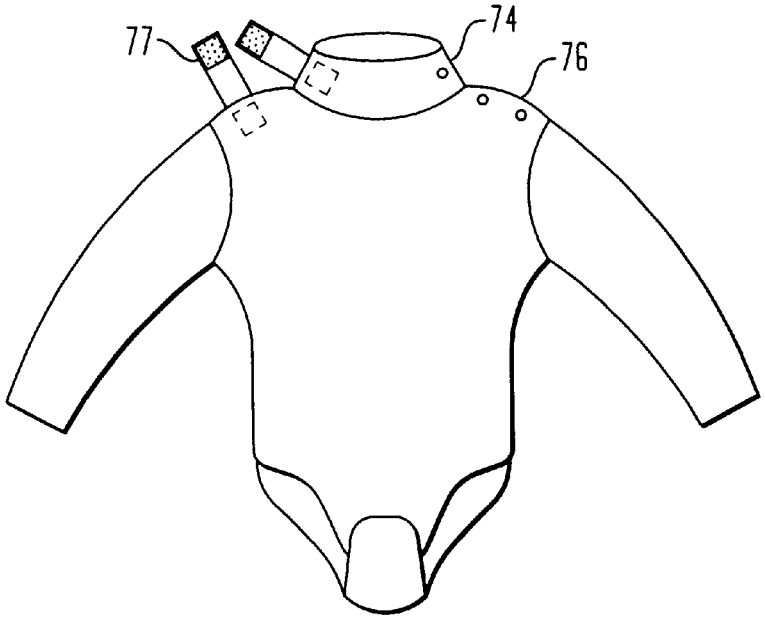
FIG. 7 is a perspective view of a further embodiment of the present invention, depicting a garment having a turtleneck, long sleeves, shoulder openings and the closure mechanism of the present invention.

FIG. 7 depicts a garment 79 in the closed position including the closing mechanism of the present invention, long sleeves, a turtle-neck 74, and shoulder openings 76 and 77. Shoulder openings 76 and 77 are depicted as differing mainly for exemplary purposes. Shoulder opening 76 is depicted as a series of snaps and shoulder opening 77 is depicted as a pair of cross-straps having Velcro™ and corresponding Velcro™ portions at or near the neck and upper torso/shoulder area of the garment. These types of shoulder is openings are exemplary in nature. There may be a shoulder opening on only one side of the garment, and if there are two, they may match one another (i.e., snaps on both sides or cross-straps on both sides) or differ. Other means may be used in the shoulder openings such as a zipper extending from the neck region to the shoulder or a Velcro™ strip extending laterally from the neck to the shoulder. (See FIG. 8). Also, the garment including shoulder openings may also include openings down the front of the garment from the neck/head opening toward or to the leg opening or crotch.

Figure 8:
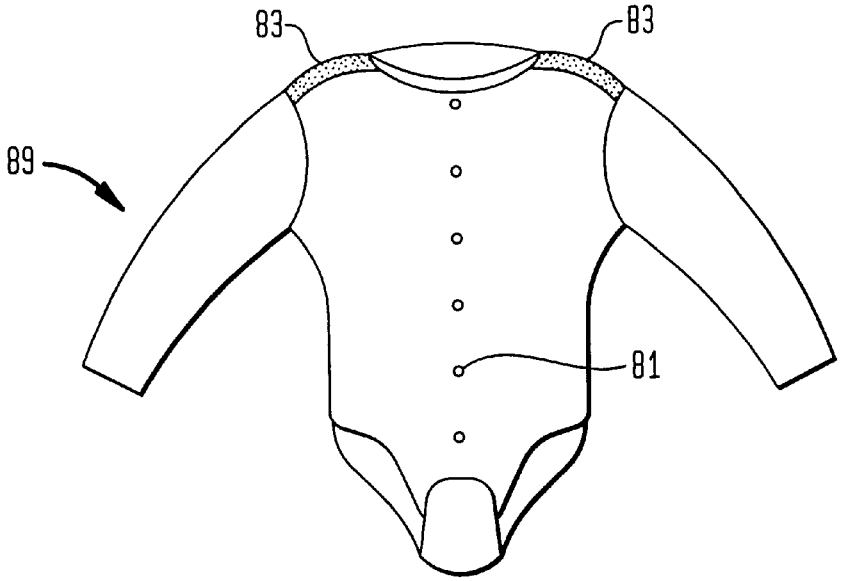
FIG. 8 is another embodiment of the present invention with the closing mechanism in the closed position having long sleeves, shoulder openings and an anterior opening utilizing snaps.
Figure 9:
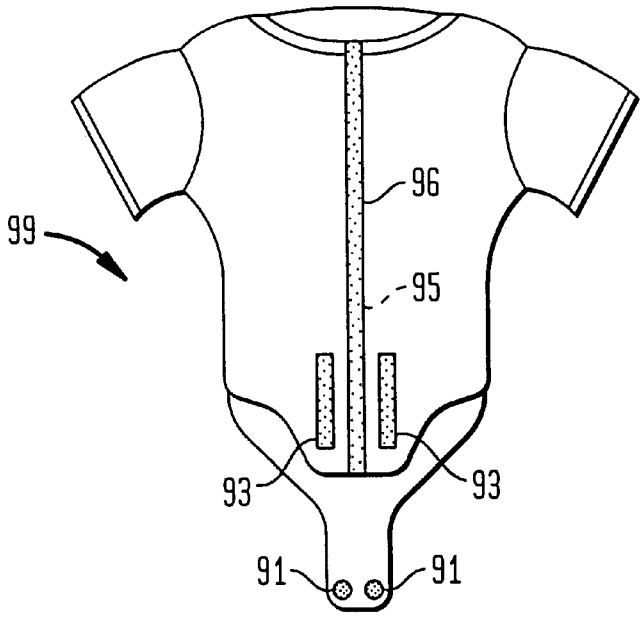
FIG. 9 depicts an embodiment of the present invention comprising a pair of corresponding hook and loop patches and an anterior opening utilizing a longitudinal hook and loop strip.
Figure 9A:
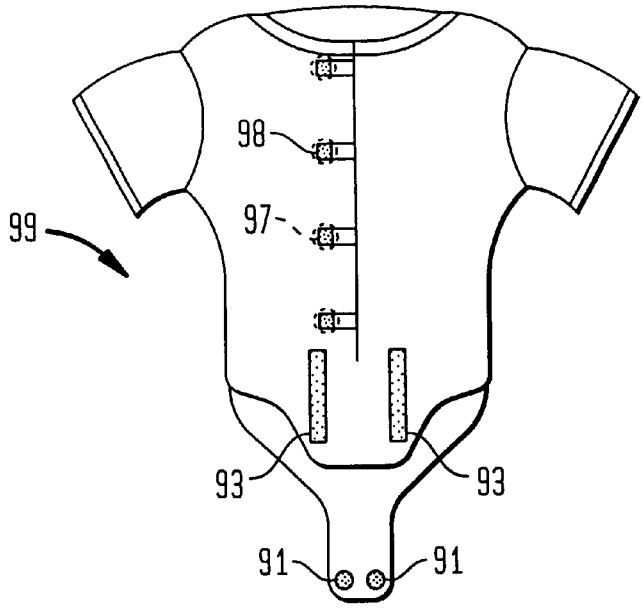
FIG. 9A depicts a further embodiment of the present invention comprising a pair of corresponding hook and loop patches and an alternative anterior opening.

A garment utilizing the closure mechanisms of the present invention may incorporate openings in the anterior of the torso region as shown in FIGS. 8, 9 and 9A. For example, FIG. 8 shows a garment 89 with the closure mechanism removably attached and additional features. Garment 89 includes a series of snaps 81 generally in a line from the center of the anterior neck/head opening to the bottom of the torso. These snaps can also extend through the anterior portion of the garment. Additionally, shoulder openings 83 are provided, each of which comprise a pair of corresponding hook and loop closure strips extending from the side of the neck opening to the top of the shoulder.

FIG. 9 depicts a garment 99 comprising the closure mechanism of the present invention and a longitudinal or vertical anterior opening. The anterior opening is accomplished with corresponding hook and loop strips 95 and 96, which extend from the neck opening through the lower torso of garment 99. FIG. 9 shows strip 95 (represented by a dashed line) as under strip 96. FIG. 9A also depicts a garment 99 including an anterior opening accomplished by a series of hook and loop cross-straps 98 that attach to corresponding patches 97. The anterior opening is shown as extending from the neck opening to a point above the edge of the anterior of garment 99, but, of course, they could be extended to the edge. The closure mechanisms in both FIGS. 9 and 9A are accomplished with corresponding pairs of patches 91 and 93. As with the previously described examples, these features may be used separately or in conjunction with any of the aforementioned closure mechanisms of the present invention (i.e., elastic patch) or in conjunction with other types of ornamentation or garment styles.

While the invention has been described with reference to specific embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An undergarment constructed of a single continuous uninterrupted section of resilient material comprising:

a torso section for covering at least the anterior and posterior of a human torso fitted to be comfortable when worn beneath an outer garment and fitted to be completely concealed when worn beneath said outer garment;

a tail panel section fitted to cover the crotch region of a human, wherein said fit is sufficiently snug to conceal said undergarment when said undergarment is worn beneath said outer garment;

a first attachable portion comprising at least one member of a loop and hook fastening pair mechanically cooperating with said torso section wherein said first attachable portion extends substantially and continuously across a significant portion of the lateral dimension of said torso section on the anterior side of the human torso; and a second attachable portion comprising at least one corresponding member of a loop and hook fastening pair mechanically cooperating with said tail panel section wherein said second attachable portion corresponds in dimension with said first attachable portion;

whereby said tail panel section extends from the posterior side of said torso section and said second attachable portion of said tail panel section removably attaches to said first attachable portion of said torso section;

wherein at least one of said loop and hook fastening members is of sufficient size to enable adjustability for varying the degree of said fit.

2. An undergarment as in claim 1, wherein said tail panel section extends from said torso section generally about the posterior of the human torso;

said tail panel section comprises an outward facing and inward facing portion;

said second attachable portion mechanically cooperates with said inward facing portion of said tail panel section; and said first attachable portion mechanically cooperates with said torso section generally about the anterior of a human torso.

3. An undergarment as in claim 2, wherein said first attachable portion comprises at least one strip of members of a loop and hook fastening pair traversing a substantially longitudinal direction upon said torso section.

4. An undergarment as in claim 3, wherein said second attachable portion comprises at least one patch of corresponding members of a loop and hook fastening pair traversing in a substantially longitudinal direction upon said inward facing portion of said tail panel section.

5. An undergarment as in claim 4, wherein said second attachable portion corresponds in size, shape and orientation to said strip of members of a loop and hook fastening pair.

6. An undergarment as in claim 2, wherein said first attachable portion comprises at least one strip of members of a loop and hook fastening pair traversing a substantially lateral direction upon said torso section.

7. An undergarment as in claim 6, wherein said second attachable portion comprises at least one patch of corresponding members of a loop and hook fastening pair traversing in a substantially lateral direction upon said inward facing portion of said tail panel section.

8. An undergarment as in claim 7, wherein said second attachable portion corresponds in size, shape and orientation to said strip of members of a loop and hook fastening pair.

9. An undergarment as in claim 1, wherein said first attachable portion comprises a plurality of members of a loop and hook fastening pair arranged such that at least one geometric shape is defined, said geometric shapes selected from the group consisting of polygons, squares, rectangles, circles, ovals, and triangles.

10. An undergarment as in claim 9, wherein said second attachable portion comprises a plurality of corresponding members of a loop and hook fastening pair arranged such that at least one shape is defined which corresponds to the geometric shape defined by said first attachable portion.

11. An undergarment as in claim 1, wherein said first attachable portion comprises a plurality of members of a loop and hook fastening pair arranged such that at least one shape is defined, said shapes selected from the group consisting of flowers, animals, human figures, characters, letters, words, numerals and logos.

12. An undergarment as in claim 11, wherein said second attachable portion comprises a plurality of corresponding members of a loop and hook fastening pair arranged such that at least one shape is defined which corresponds to the shape defined by said first attachable portion.

13. An undergarment as in claim 1, wherein said tail panel section comprises a resilient material.

14. An undergarment as in claim 13, wherein said resilient material is selected from the group consisting of spandex, Lycra and elastic.

15. An undergarment as in claim 1, wherein said tail panel section further has attachable portions comprising at least one member of a loop and hook fastening pair mechanically cooperating with said outward facing portions of said tail panel section; and, wherein said torso section further has at least one flap member mechanically cooperating with said torso section, said flap members having an exposed side and attachable side, said attachable side mechanically cooperating with at least one corresponding member of a loop and hook fastening pair.

16. An undergarment as in claim 1, wherein said torso section further comprises a dress.

17. An undergarment as in claim 1, wherein said first attachable portion and said second attachable portion is of equal size and of sufficient size to enable adjustability for varying the degree of said fit.

* * * * *